United States Patent [19]

Paque

[11] 4,360,278

[45] Nov. 23, 1982

[54] PRINTING APPARATUS HAVING INTERCHANGEABLE LARGE CHARACTER TYPE FONTS AND TAPE-RIBBON CARTRIDGE THEREFOR

[75] Inventor: Michael W. Paque, Stillwater, Minn.

[73] Assignee: Kroy Inc., St. Paul, Minn.

[21] Appl. No.: 103,749

[22] Filed: Dec. 17, 1979

[51] Int. Cl.[3] ..... B41J 1/30

[52] U.S. Cl. ..... 400/134.3; 400/134.6; 400/208; 400/466; 400/613; 400/654; 400/662; 400/248

[58] Field of Search ..... 400/134.3, 134.5, 134.6, 400/208, 223, 241.4, 594.1, 466, 613, 615.2, 617, 654, 662; 101/269, 272

[56] References Cited

U.S. PATENT DOCUMENTS

| | | | |
|---|---|---|---|
| 992,461 | 5/1911 | Vandercook | 101/269 |
| 1,042,848 | 10/1912 | Vandercook | 101/272 |
| 1,076,084 | 10/1913 | Vandercook | 101/269 |
| 1,137,299 | 4/1915 | White | 101/269 |
| 1,499,582 | 7/1924 | Laguionie | 400/662 X |
| 2,295,210 | 9/1942 | Gutensohn | 400/662 X |
| 2,422,406 | 6/1947 | Gordon | 400/662 X |
| 2,930,465 | 3/1960 | Lotsch | 400/613 X |
| 3,272,120 | 9/1966 | Johnson | 101/269 X |
| 3,294,212 | 12/1966 | Gearheart et al. | 400/613 |
| 3,455,431 | 7/1969 | Martin | 400/223 |
| 3,532,053 | 10/1970 | Lieberman | 101/269 |
| 3,768,619 | 10/1973 | Lewis | 400/615.2 X |
| 3,834,507 | 9/1974 | Bradshaw | 400/134.6 |
| 3,912,064 | 10/1975 | Bluem et al. | 400/134.6 |
| 4,015,700 | 4/1977 | Paque | 400/617 |
| 4,108,556 | 8/1978 | Connoy | 400/654 X |
| 4,226,547 | 10/1980 | Bradshaw et al. | 400/613 |

FOREIGN PATENT DOCUMENTS

| | | | |
|---|---|---|---|
| 7030 | 1/1980 | European Pat. Off. | 400/613 |
| 926588 | 5/1963 | United Kingdom | 400/134.6 |

*Primary Examiner*—Ernest T. Wright, Jr.
*Attorney, Agent, or Firm*—Dorsey & Whitney

[57] ABSTRACT

A printing apparatus of the type having a printing station, a printing force exerting and resisting means, an image carrier and a font element with a raised character and a tape-ribbon cartridge therefor. The improvement of the present invention relates to an improved device for exerting a printing force and an improved tape-ribbon cartridge for supplying tape and ribbon to the printing station and for guiding and supporting the font element into printing alignment.

20 Claims, 11 Drawing Figures

PRINTING APPARATUS HAVING INTERCHANGEABLE LARGE CHARACTER TYPE FONTS AND TAPE-RIBBON CARTRIDGE THEREFOR

BACKGROUND OF THE INVENTION

The present invention relates generally to an improved printing apparatus or composing system and tape-ribbon cartridge therefor, and more particularly, to a printing apparatus of the type having a printing station, a printing force exerting and resisting means, an image carrier and a font element with a raised character positionable in printing alignment with the printing station. The improvement of the present invention relates specifically to an improved means for exerting a printing force against the raised character on the font element and an improved means in the form of a tape-ribbon cartridge for supplying tape and ribbon to the printing station.

The printing apparatus of the present invention has particular application in the printing of relatively large characters for use in engineering drawing title blocks, flip charts, overhead transparencies, posters, silk screen stencils, signs, newspaper headlines and the like. These characters are generally much larger than most typewriters or other conventional means can generate. In the prior art four major methods have been used to create such letters: stencils, press-on letters, phototype setters and dry lettering printing processes. The application of stencils and press-on letters to form words, sentences is relatively time consuming. In addition, it is easy to misalign letters and get uneven spacing. Photo typesetting systems are rather large, expensive, permanent installations having several chemical baths that must be maintained. Further, a trained operator is necessary to get good results. Although the dry lettering processes presently used overcome many of the disadvantages and limitations of stencils, press-on letters and photo typesetters, a relatively large printing force is necessary to transfer an image of the desired character from the high-carbon content toners to the image carrier. Generally, the quality of the printing or the image transfer is dependent upon the magnitude of the printing force developed.

In prior art dry lettering systems, a variety of printing force exerting means have been utilized. One such means involves the use of a printing piston having a flat upper surface disposed in printing relationship with the printing surface. Such printing piston is lifted by a cam element, thereby creating a printing force to transfer an image to the image carrier. Another means for creating printing pressure is shown in U.S. Pat. No. 4,108,556 which utilizes a wedge-shaped element for creating the necessary printing force as it rolls across the printing station.

SUMMARY OF THE INVENTION

In general, the present invention relates to an improved means for supporting and guiding a rolling force exerting piston of the type generally illustrated in U.S. Pat. No. 4,108,556 and an improved tape-ribbon cartridge for providing tape and ribbon to the printing station in such a printing apparatus and for supporting the printing font element.

The improved support and guide means includes a rack and gear assembly, one element of which is connected with the apparatus frame and the other element of which is connected with the rolling piston to align it properly as it rolls across the printing station. The position of and relationship between the rack and gear sections causes the printing piston to move across the printing station in true rolling contact motion.

The improved tape-ribbon cartridge includes a cartridge housing containing a supply of printing tape and ribbon and a generally elongated tape-ribbon guide portion to assist in properly positioning and guiding the tape and ribbon relative to the printing station. The cartridge also provides a support and alignment means for the insertable font element and a printing window through which the printing force is applied against the force resisting means.

Accordingly, it is an object of the present invention to provide an improved printing apparatus of the type generally shown in U.S. Pat. No. 4,108,556 having improved means for supporting and guiding the printing piston during its rolling movement across the printing surface.

Another object of the present invention is to provide an improved tape-ribbon cartridge for a printing apparatus.

A further object of the present invention is to provide a printing cartridge having means for properly aligning and supporting a printing chip or font element.

Another object of the present invention is to provide an improved combination printing apparatus and tape-ribbon cartridge for use in connection therewith.

These and other objects of the present invention will become apparent with reference to the drawing, the description of the preferred embodiment and the appended claims.

DESCRIPTION OF THE DRAWING

FIG. 10 is a cross sectional view showing the means for maintaining activation of the printing cycle.

DESCRIPTION OF THE PREFERRED EMBODIMENT

Figure 1D:
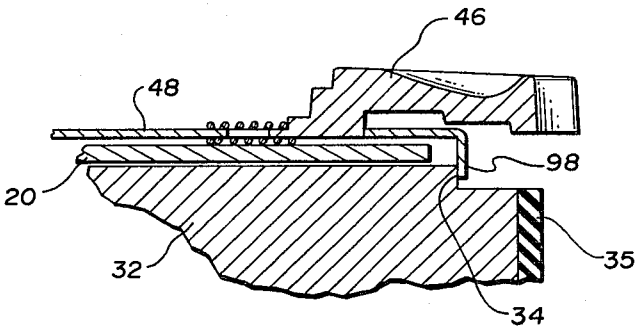
FIG. 1, comprised of FIGS. 1*a* and 1*b*, is an exploded, pictorial view of the printing apparatus and improved tape-ribbon cartridge of the present invention.
Figure 1A:
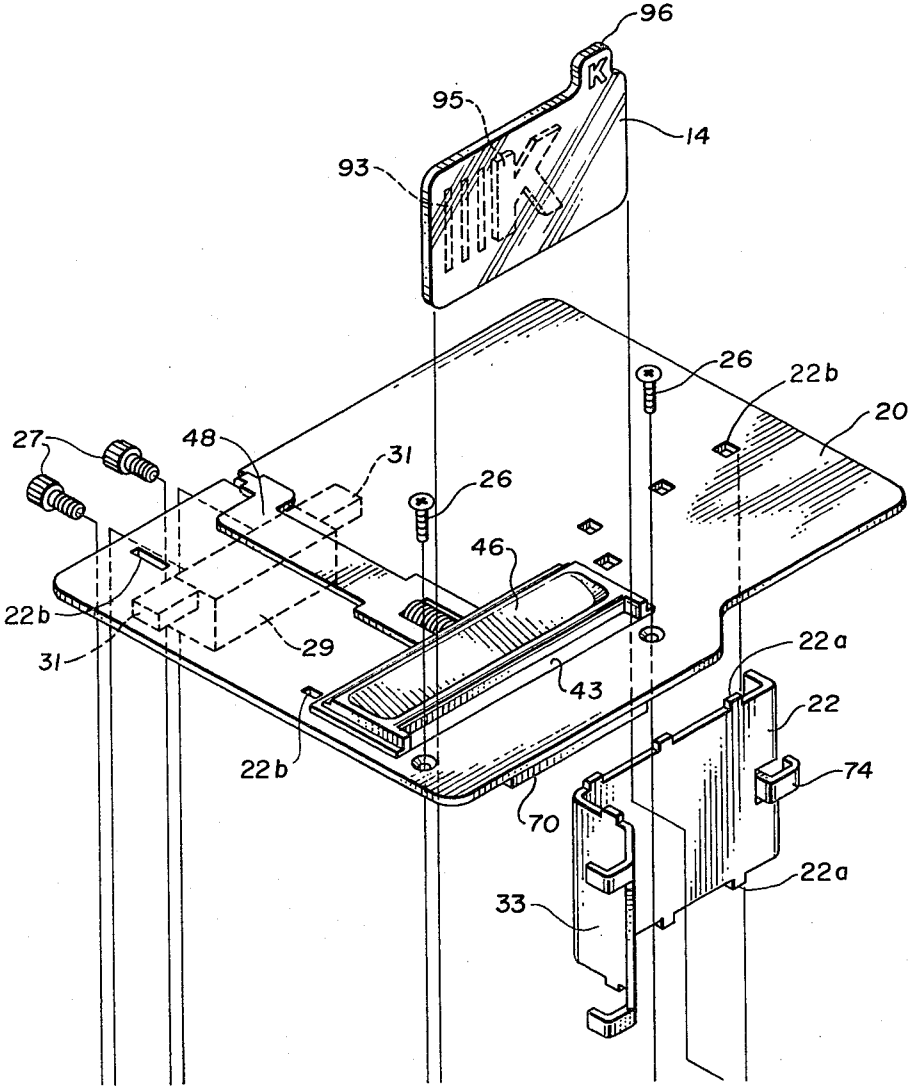
Figure 1B:
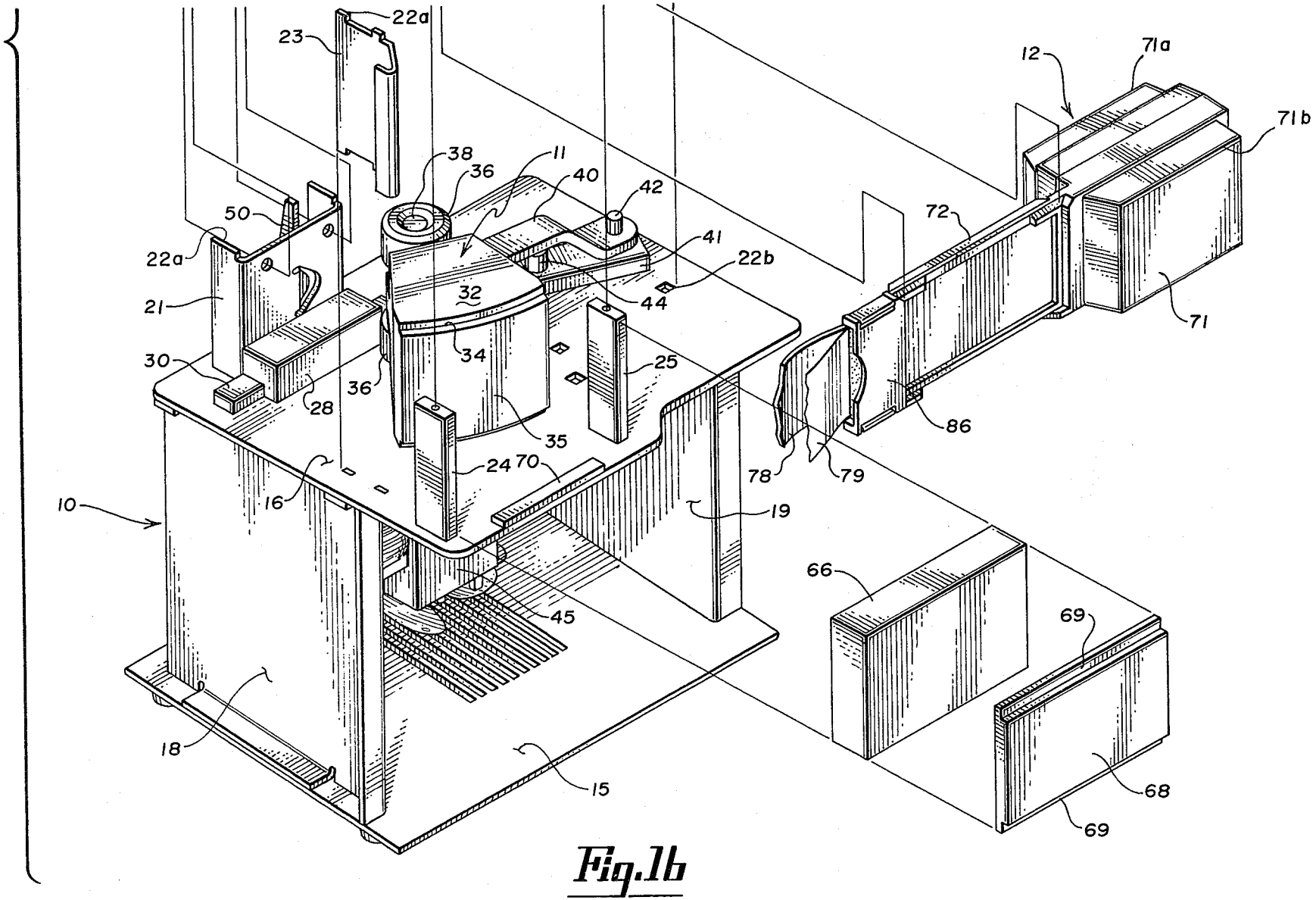

Reference is first made to FIG. 1 which is an exploded, pictorial view of the printing apparatus and tape-ribbon cartridge of the present invention. As shown in FIGS. 1*a* and 1*b*, the apparatus of the present invention includes a lower housing 10, a printing piston 11 for exerting a printing force toward a printing station, and a tape-ribbon cartridge 12 for supplying tape 78 and ribbon 79 to the printing station and for properly aligning and supporting a font element 14.

The lower housing 10 includes bottom and top members 15 and 16 and a pair of side members 18 and 19. The side members 18 and 19 are secured at their upper edges to the lower surface of the top member 16 and at their lower edges to the upper surface of the bottom member 15. The members 15, 16, 18 and 19 may be secured together either by screws, bolts, welds or any other appropriate means.

Positioned above the lower housing 10 is an upper housing defined by the frame member 16 and a vertically spaced frame member 20. These members 16 and 20 are joined together in spaced relationship to form an upper housing for the printing piston 11 and the tape-ribbon cartridge 12. The frame members 16 and 20 are generally flat plates which are secured to each other in spaced relationship by the support brackets 21, 22 and 23 and by the pair of support posts 24 and 25. In the preferred embodiment, the bracket 21 is fastened to a rearward surface of the support or printing piston rails 28 and 29 by the screws 27 and the brackets 22 and 23 are held in place between the plates 16 and 20 by tabs 22*a* protruding into slots 22*b* in the plates 16 and 20. The support posts 24 and 25 are secured by the screws 26. Each of the inner surfaces of the frame members 16 and 20 includes a printing piston rail 28 and 29, respectively, for guiding and supporting the printing piston 11 during a printing cycle. The rails 28 and 29 are securely fastened to their respective members 16 and 20 by welding or other appropriate means. Disposed at each longitudinal end of the rails 28 and 29 is an end rail section 30 and 31, respectively. As will be discussed in greater detail below, these end rail sections 30 and 31 support the printing piston 11 at each end of the printing cycle. These end rail sections 30 and 31 are also rigidly secured to the frame members 16 and 20 by welding or other appropriate means.

Figure 2:
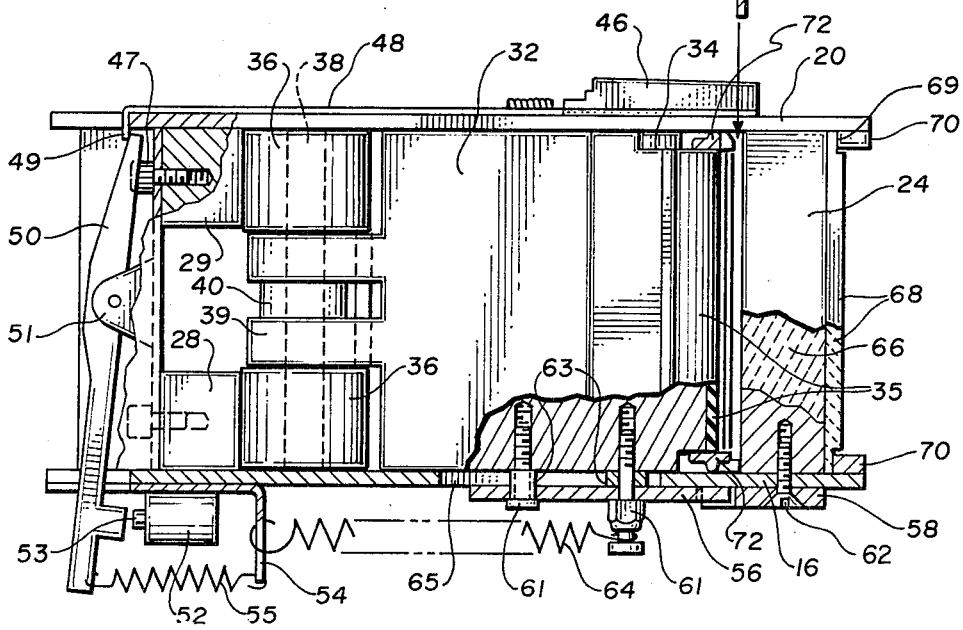
FIG. 2 is a plan view, partially in section, showing the side of the rolling piston element and the means for actuating the printing cycle.
Figure 3:
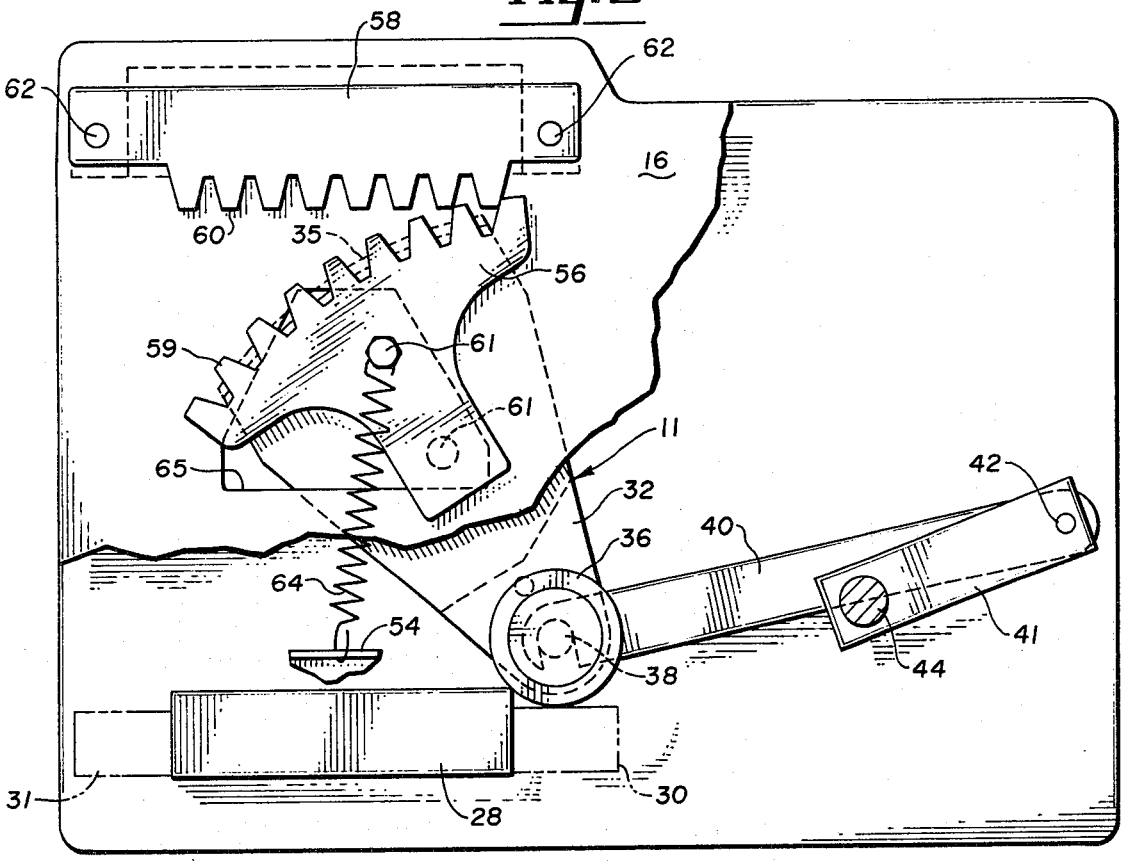
FIG. 3 is a plan view showing the printing force exerting piston at one of its end positions and showing the improved means for guiding and supporting the piston during the printing cycle.
Figure 4:
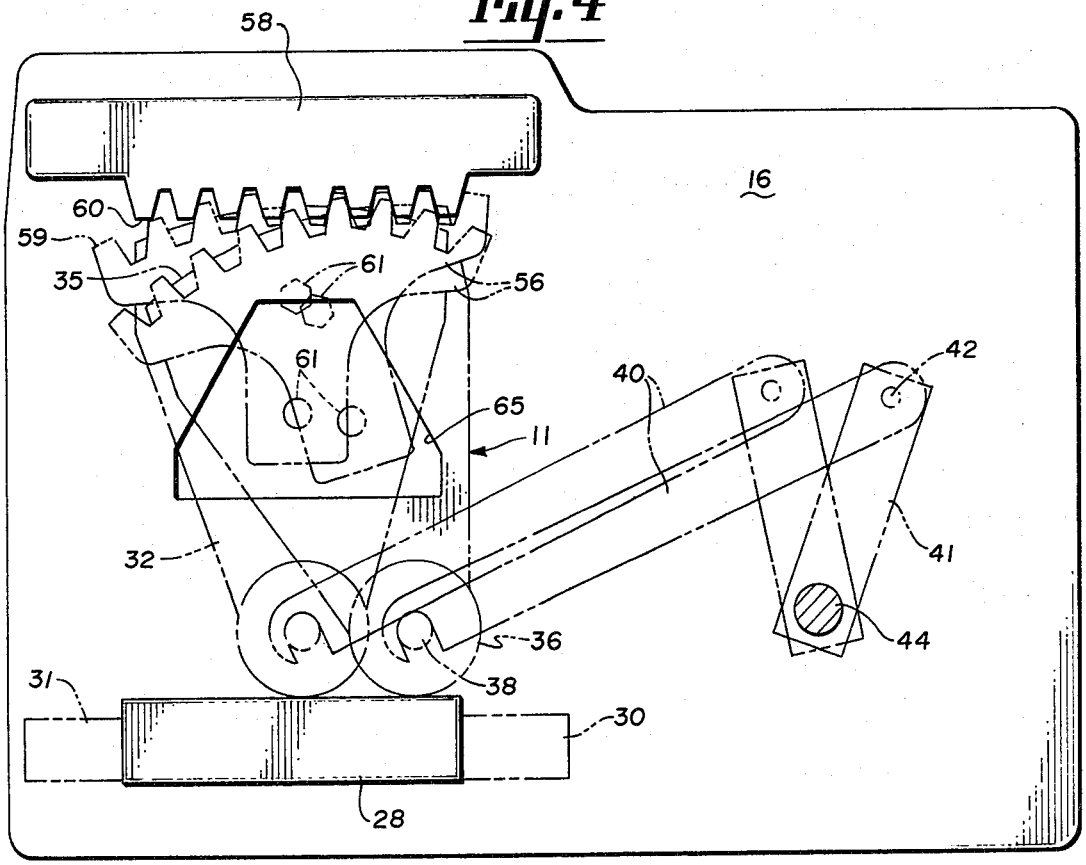
FIG. 4 is a plan view of the printing force exerting piston, similar to FIG. 3, showing the piston in various positions during the printing cycle.

As shown best in FIGS. 1–4, the printing piston 11 includes a generally wedge-shaped roller segment 32 having a curved surface, a urethane pad 35 secured to the curved surface, a shoulder portion 34 conforming to the curvature of the curved surface and a pair of rollers or bearing members 36 rotatably supported on an axle or shaft 38. The roller shaft 38 is journalled within portions 39 (FIG. 2) of the roller segment 32 to rotatably support the rollers 36 for rolling movement along the rails 28 and 29. As best illustrated in FIGS. 3 and 4 rolling motion is imparted to the roller segment 32, and in particular the curved surface of the urethane pad 35, by an elongated connecting link 40 and a crank member 41. One end of the connecting link 40 is rotatably connected with the bearing member shaft 38 while the other end of the link 40 is rotatably connected at the pivot 42 to the crank member 41. The other end of the crank member 41 is secured to a shaft 44 associated with an electric motor 45 (FIG. 1*b*) for movement therewith. As shown in FIG. 2, the connecting link 40 is positioned between the portion 39. To impart true rolling movement to the piston 11, the radius of curvature of the curved urethane pad surface 35 has its center at the axial center of the shaft or axle 38.

With reference to FIGS. 1 and 2, the means for actuating the electric motor 45 includes the elongated print or switch bar 46 and the force transfer links 48 and 50. The members 46 and 48 are associated with each other with a surface of the bar 46 engaging a portion of the link 48 (FIG. 10), such that movement of the switch bar 46 toward the front of the printing apparatus moves the link 48 in a forward direction. As illustrated best in FIG. 2, the elongated link 48 includes a downwardly extending portion 49 which engages a motion transfer link 50. The link 50 is pivotally secured at its midpoint to a flange portion 51. Forward movement of the print bar 46, and thus link 48, causes clockwise movement of the link 50, thus releasing the switch member 53 of the microswitch 52. This results in activation of the motor 45 and commencement of the printing cycle. The printing cycle is maintained as the roller segment 32, and particularly the shoulder portion 34, moves forward into contact with a downwardly extending tab portion 98 (FIG. 10) located at the forward end of the link 48. Once the roller segment 32 has started to move forward, engagement between the shoulder 34 and tab 98 prevents the link 48 and other switching linkages from moving back into their off position during the printing cycle. When the roller segment 32 has traversed to the opposite end of the rails 28 and 29, the rollers 36 drop down onto the end rail sections 30 and 31, thus allowing the tab 98 to move rearwardly. This latter movement results in corresponding rearward movement of the link 48 and print bar 46 and thus counterclockwise movement of the link 50 as a result of the spring 55. The counterclockwise movement of the link 50 depresses the switch member 53, thus deactivating the printing cycle. The spring 55 extends between the lower end of the link 50 and the bracket 54.

Upon forward movement of the print bar 46 and activation of the printing cycle, the electric motor 45 (FIG. 1) provides rotational movement to the shaft 44. This rotational movement, through the link 40 and the crank member 41, causes generally transverse rolling movement of the rollers 36 along the rails 28 and 29. As illustrated in FIGS. 3 and 4, the translational movement of the rollers 36 is guided by first and second gear sections comprising the gear section or segment 56 and the associated gear rack 58. The gear section 56 is securely fastened to the generally wedge-shaped roller segment 32 by a pair of bolts 61 and includes a plurality of gear teeth 59. The gear rack 58 is securely fastened to the lower frame member 16 by the screws 62 and includes a plurality of gear teeth 60 adapted to mesh with the gear teeth 59 of the gear section 56. During a printing cycle the teeth 59 of the gear segment 56 maintain a constant engagement with the teeth 60 of the gear rack 58 to properly align the printing piston 11 (FIG. 1) in printing registration with the printing station. It should be noted that the pitch line of the gear segment 56 coincides with the curved surface of the polyurethane pad 35. Therefore, as the printing piston 11 moves back and forth, the surface of the polyurethane pad 35 is moved along in true rolling contact motion with respect to the printing station. In the preferred embodiment, the gear teeth 59 are positioned arcuately along an outer edge of the gear segment 56 and the gear teeth 60 are disposed along a straight line. It is contemplated however, that the gear and rack sections 56 and 58 could be reversed (i.e.) the rack 58 could be mounted to the roller segment 32 and the gear segment 56 mounted to the lower frame member 16. In fact, the corresponding gear teeth 59, 60 of the gear segment 56 and rack 58 could be disposed along various paths as long as the meshing of such teeth 59, 60 results in true rolling movement of the wedge-shaped roller segment 32 and in particular the curved surface of the pad 35 with respect to the printing station.

FIGS. 3 and 4 show the printing piston 11 in various positions during a printing cycle. FIG. 3 shows the printing piston 11 in one of its end positions. In its end position, the rollers 36 are supported by the pair of end rail sections 30 and 31 disposed at each end of the support rails 28 and 29. A spring member 64 extending between one of the bolts 61 and the bracket 54 causes the rollers 36 to be moved onto the end rail sections 30 and 31 at the end of each printing cycle, thereby causing generally rearward movement of the wedge-shaped roller segment 32 and the gear segment 56. Upon commencement of a printing cycle, the rollers 36 move back upon the support rails 28 and 29 and the gear teeth 59 and 60 become engaged to cause the roller segment 32 to move in rolling movement with respect to the printing station such that a normal or perpendicular printing force is exerted against successive portions of the printing surface.

In the preferred embodiment, the wedge-shaped roller segment 32 of the printing piston 11 is disposed between and guided by the upper and lower frame members 20 and 16, respectively, while the gear segment 56 and the gear rack 58 are mounted below the lower frame member 16. To permit connection between the gear segment 56 and the roller segment 32, an opening 65 is provided in the frame member 16. The gear segment 56 is mounted in spaced relationship with respect to the roller segment 32 to permit a portion of the frame 16 to extend between the two elements 56 and 32. The spacing is accomplished by the bushings or spacing members 63 associated with the bolts 61. It should be noted that the spacing members 63 may be separate bushings as shown in FIG. 2 or bosses integrally joined with the roller segment 32.

As shown in FIGS. 1 and 2, a transparent glass window 66 comprised of a solid glass block is disposed between the frame members 16 and 20 and between the support posts 24 and 25. Positioned immediately forward of the glass block 66 is a tranparent plastic safety window 68 having a pair of shoulder portions 69 on each edge. When assembled, these shoulder portions 69 are engaged by the retaining rail members or brackets 70 which are rigidly secured to the opposing inner surfaces of the frame members 16 and 20. As illustrated best in FIG. 2, the rearward surface of the glass block 66 defines the surface against which the printing force generated by the printing piston 11 is exerted. This exertion of printing pressure is then resisted by the plastic window 68 and ultimately by the pair of retaining brackets 70. In the preferred embodiment, the glass block 66 is approximately $\frac{3}{4}$ of an inch thick while the plastic window 68 is approximately $\frac{1}{8}$ of an inch thick. It has been found that these thicknesses are sufficient to withstand the printing pressures created in the present apparatus which can be in excess of 2000 p.s.i. The combination of the glass window 66, the plastic window 68 and the retaining rail members 70 function together as the means for resisting the printing force.

With reference to FIG. 1*b*, the tape-ribbon cartridge 12 is adapted for positioning between the frame members 16 and 20 to provide image carrying tape 78 and printing ribbon 79 to the printing station defined in part by the rearward face of the glass block 66. The tape-ribbon cartridge 12 includes a cartridge body or housing 71 and an elongated tape guide portion or snout member 72 extending outwardly from the housing 71. The cartridge 12 is retained within the printing apparatus by the support or cartridge retaining bracket 22. When properly inserted, the tape guide portion 72 is positioned immediately behind the glass block 66 and the housing 71 is retained by the bracket 22 and the spring clip member 74. In this position, one edge of the housing section 71*a* is engaged by the outwardly extending portion 33 of the bracket 22, while the opposite edge of the section 71*a* is engaged by the member 74.

Figures 5, 6, 7:
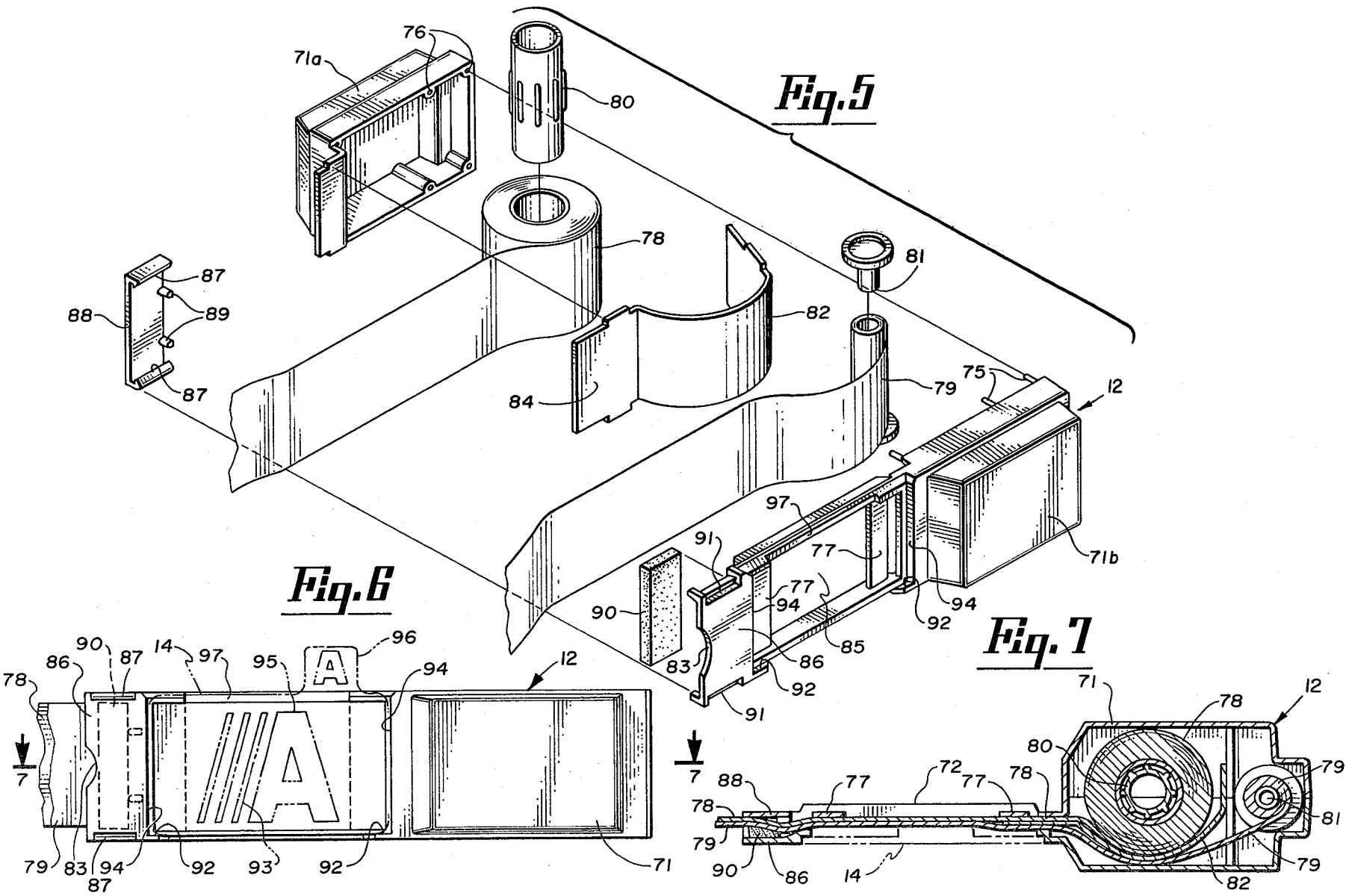
FIG. 5 is an exploded, pictorial view of the improved tape-ribbon cartridge of the present invention.
FIG. 6 is a plan view of the tape-ribbon cartridge of the present invention.
FIG. 7 is a sectional view of the tape-ribbon cartridge as viewed along the section lines 7—7 of FIG. 6.

As illustrated best in FIGS. 5 and 7, the cartridge housing 71 is formed from a pair of housing sections 71*a* and 71*b* which are joined together by a plurality of connecting posts 75 and corresponding holes 76. Disposed within the housing 71 is a supply of image carrying adhesive backed tape 78 and a supply of colored toner ribbon 79. The ribbon 79 can consist of a high-carbon content ribbon, although non-carbon toners can also be utilized. The supply of tape 78 and ribbon 79 is in roll form, with each of the rolls being rotatably supported within the housing 71 by appropriate support members 80 and 81, respectively. Also disposed within the housing 71 is a tape-ribbon divider 82 which assists in guiding the tape 78 and ribbon 79 out of the housing 71 and also in maintaining separation between the tape 78 and ribbon 79 to prevent relative movement between the tape 78 and ribbon 79 during the feeding process. This, accordingly avoids the undesirable depositing of carbon from the ribbon 79 onto the tape 78 which is often caused by relative movement between the two surfaces. The divider 82 is disposed within the housing 71 and includes a section 84 which extends outwardly from the housing 71 to continue guiding and separating the tape 78 and ribbon 79 for a portion of its travel along the snout member 72. In the preferred embodiment the divider 82 is a paper divider which has a smooth surface in contact with the ribbon 79 to prevent scratching the ribbon 79 during the feeding process.

The snout member or tape guide portion 72 is integrally joined with the housing section 71*b* and extends outwardly therefrom to support and guide the tape 78 and ribbon 79 during their movement into alignment with the printing station. As illustrated best in FIG. 5, the elongated snout member 72 includes an opening 85 and an outer end section 86. A pair of sections 77 define the side edges of the opening 85 and assist in guiding the tape 78 and ribbon 79 through the snout member 72. Associated with the end section 86 is a corresponding tape-ribbon retaining clip member 88. The clip member 88 includes a pair of end latch members 87 for appropriate connection with corresponding latch seats 91 in the end section 86 and a pair of tape engaging ribs 89. A foam pad 90 is positioned between the members 86 and 88 to hold the tape and ribbon materials in contact with each other as they are dispensed from the tape-ribbon cartridge 12. As illustrated in FIG. 7, the tape 78 and ribbon 79 are fed between the members 86 and 88 with the foam pad 90 being disposed between the ribbon 79 and inner surface of the end section 86. The pair of ribs 89 formed on the inside surface of the member 88 are used to facilitate the use of narrower printing materials by providing an additional guiding means so as to maintain an accurate center line position of the materials as they pass through the cartridge 12. It should be noted that the foam pad 90 has sufficient composition to retain the tape 78 and ribbon 79 in contact with each other so as to avoid inadvertent or undesirable relative movement with respect to each other, but also sufficient resiliency and flexibility to avoid pressure which would result in the depositing of carbon from the ribbon 79 onto the tape material 78. The end section 86 also includes a recessed portion 83 to permit manual grasping of the tape 78 and ribbon 79 for advancing the same.

The tape guide portion or elongated snout member 72 also includes means for guiding the font element 14 into printing alignment and for supporting the element 14 during a printing cycle. This means includes a pair of tab or support members 92 and a pair of side guide portions 94 to properly support and guide the printing font element or chip 14 into printing alignment. As illustrated in FIGS. 6 and 7, when the font element 14 is properly positioned, the bottom surface rests on the support tabs 92 while the side edges are guided and aligned horizontally by the side guide portions 94.

The font chip 14 is a generally rectangular shaped element having a raised character 95, a tab portion 96, and a plurality of alignment indicia 93. When properly inserted into the snout member 72, the raised portion of the character 95 faces the opening 85 and the tab portion 96 extends above the tape-ribbon cartridge 12. The snout member or tape guide portion 72 includes a recessed portion 97 immediately above the opening 85 to permit the element 14 with raised characters 95 thereon to be inserted into the cartridge 12 when the cartridge 12 is properly positioned within the apparatus.

Figure 8:
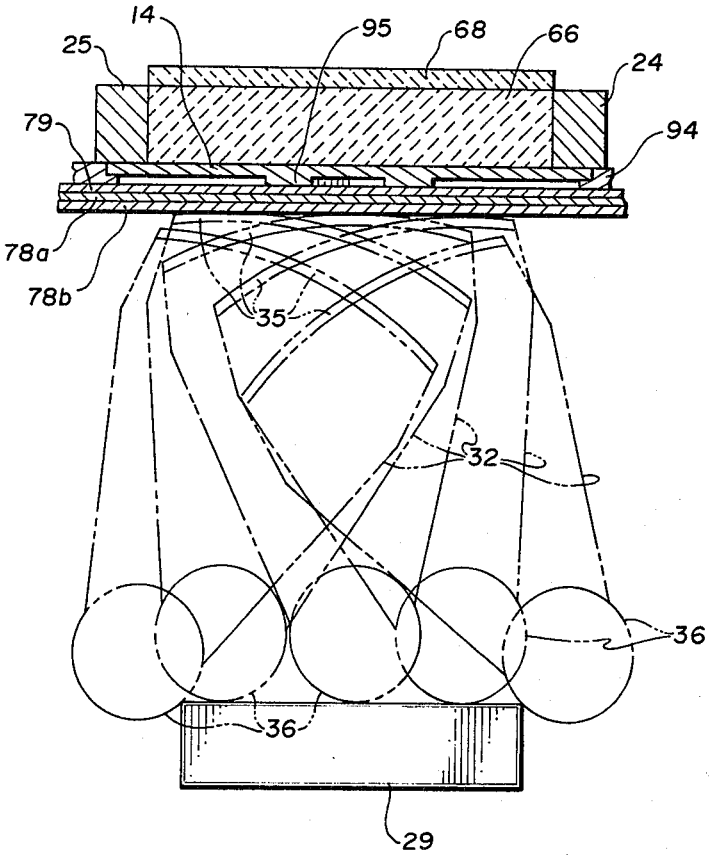
FIG. 8 is a top view, partially in section, showing successive positions of the printing piston during the printing cycle.
Figure 9:
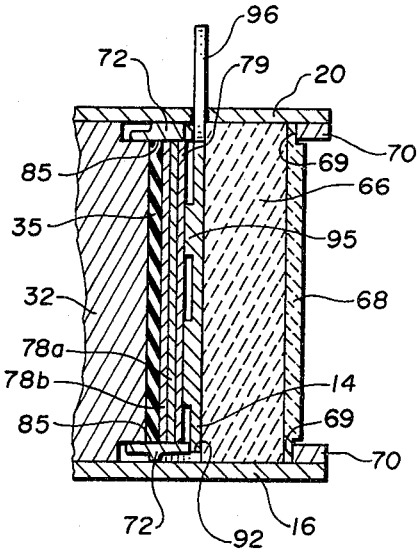
FIG. 9 is a side view, partially in section, showing the printing piston and its relationship to the tape-ribbon cartridge during a printing cycle.
Figure 9:
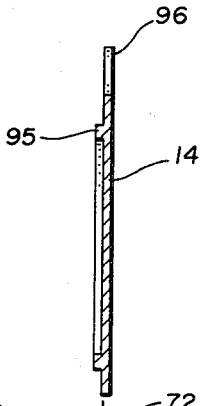

FIGS. 8 and 9 show views of the printing roller segment 32 exerting a printing force aagainst the font element 14 during a printing cycle. When properly inserted, the snout member 72 is disposed immediately behind the glass block 66 and a portion of the snout member 72 forms a cavity to receive the font element 14. Such cavity is defined in part by the rearward surface of the glass window 66, forward portions of the snout member 72, the side guide portions 94 and the tab members 92. Disposed immediately to the rear of the font element 14 are the tape and ribbon members 78 and 79 which extend across the opening 85 in the snout member 72. As shown the tape 78 includes an adhesive backed, image carrying film layer 78*a* and a supporting upper layer 78*b*. During the printing cycle, the urethane pad 35 secured to the curved surface of the roller segment 32 presses against the raised characters 95 of the font element 14 with the tape 78 and ribbon 79 members disposed therebetween. This causes the transfer of an image of the raised character 95 from the carbon ribbon 79 to the image carrying tape 78. As shown best in FIG. 9, the roller segment 32 is guided in its rolling movement in part by the inner surfaces of the frame member 16 and 20. Accordingly, the general thickness of the roller segment 32 is slightly smaller than the distance between the frame members 16 and 20 to allow freedom of movement therebetween. Additionally, the outer curved portion of the roller segment 32 has a reduced width to permit the outer curved portion and the urethane pad 35 to extend through the opening 85 to exert the necessary printing pressure against the font element 14.

The operation of the present printing apparatus can be described as follows. First, the machine operator inserts the tape-ribbon supply cartridge 12 into the machine until the retaining latch 74 snaps into position to hold the cartridge 12 in place. In this position, the tape guide portion or snout member 72 is disposed immediately to the rear of the glass block 66. A type chip or font element 14 bearing the desired character 95 is then selected from a container (not shown) and inserted down through the opening 43 (FIG. 1) in the top of the machine. As shown best in FIGS. 2, 8 and 9, the chip 14 is inserted into a cavity defined by the rearward face of the glass block 66 and portions of the snout member 72. The chip 14 is properly aligned and supported by the side guide portions 94 and the support tabs 92.

The printing cycle is then initiated by pulling the print bar 46 on top of the machine forward. This movement releases the switch member 53 (FIG. 2) and activates the electric motor 45. The connecting link 40 and crank member 41 transmit the force of the motor 45 to the printing piston 11 and causes the rollers 36 to move off the end rail sections 30 and 31 and onto the rails 28 and 29. As the printing cycle continues, the rollers 36 roll along the support rails 28 and 29 traversing from one side to the other. During this movement, a narrowed portion of the wedge-shaped roller segment 32 including the polyurethane pad 35 secured to the surface of such portion passes through the opening 85 in the snout member 72 of the cartridge 12 and contacts the rear surface of the tape 78. This results in printing pressure being applied, thus causing an image of the raised character 95 on the font element 14 to be transferred from the colored ribbon 79 to the tape 78. During transverse movement of the roller segment 32 from one side to the other, constant engagement is maintained between the teeth 59 on the gear segment 56 and the teeth 60 on the rack 58. In the preferred embodiment, the pitch line of the gear segment 56 coincides with the surface radius of the polyurethane pad 35, thus insuring true rolling contact motion between the surface of the urethane pad 35 and the printing materials.

The front rail members 70 secured to the top and bottom frame plates 20 and 16 resist motion of the glass block 66 and plastic window 68 and thus the font element 14. This resistance results in significant printing force as the rolling piston 11 rolls across the support rails 28 and 29 from one side to the other. In the preferred embodiment, the distances which are involved between the roller segment 32 and the raised character 95 of the font-type chip 14 when inserted in printing alignment are such that during the printing cycle the polyurethane pad 35 is compressed approximately 0.010 of an inch. This amount of compression generates the correct amount of pressure to transfer toner from the carbon ribbon 79 onto the surface of the tape 78. In the apparatus of the present invention, this can be about 2,000 pounds per square inch.

As the roller segment 32 nears the end of its travel, the bearing members 36 of the roller segment 32 move off the end of the support rails 28 and 29 and onto the end rail sections 30 and 31. This movement is a result of the force exerted by the extension spring 64. When the rollers 36 have moved to their proper end position, the switching system is deactivated.

The type chip 14 which has been printed is then removed from the machine by the operator and the next character 95 to be printed is inserted into the machine. The operator can view the new chip 14 through the glass and plastic windows 66 and 68. The operator then grasps the tape 78 and ribbon 79 by hand, near the outer edge of the snout member 72 and pulls the tape 78 and ribbon 79 from the cartridge 12 until proper spacing is desired. When the spacing is completed, the print bar 46 is again pulled forward, thereby activating a further printing cycle. When a word or sentence is completed, the tape 78 and ribbon 79 are pulled out of the cartridge snout member 72 far enough so that the materials may be cut off with a scissors.

Although the description of the preferred embodiment has been quite specific, it is contemplated that various changes could be made to the structure without deviating from the spirit of the present invention. Accordingly, it is contemplated that the scope of the present invention be dictated by the appended claims rather than by the description of the preferred embodiment.

I claim:

1. A printing apparatus comprising:

a printing station;

a force resisting means for resisting a printing force;

a force exerting means positioned in printing alignment with said printing station for exerting a printing force toward said force resisting means;

an interchangeable font element having a raised character positionable in printing alignment with said printing station; and a removable cartridge having a housing containing a supply of image carrying tape and a tape and font guide portion integrally connected with and extending outwardly from said housing, said tape and font guide portion positionable between said force resisting means and said force exerting means and including an opening to define said printing station, said tape and font guide portion further including a pair of spaced guide edges for guiding said interchangeable font element into printing alignment and a support edge for supporting said interchangeable font element during a printing cycle.

2. The printing apparatus of claim 1 wherein said interchangeable font element comprises a generally rectangular font chip having a single raised character thereon.

3. The printing apparatus of claim 2 wherein said opening is generally rectangular.

4. The printing apparatus of claim 2 wherein said force resisting means includes a transparent glass block.

5. The printing apparatus of claim 4 wherein said force resisting means further includes a pair of force resisting rails.

6. The printing apparatus of claim 1 wherein said housing also contains a supply of printing ribbon.

7. The printing apparatus of claim 1 wherein the printing force is exerted by said force exerting means through said opening in said tape and font guide portion.

8. The printing apparatus of claim 7 wherein said force exerting means includes a curved force exerting surface and support and guide, means for supporting and guiding said force exerting surface in rolling movement with respect to said printing station such that a normal printing force is exerted against successive portions of said raised character during said rolling movement.

9. The printing apparatus of claim 8 including a pair of frame members each having a generally flat surface in spaced relationship with and parallel to the flat surface of the other frame member wherein said tape and font guide portion is positionable between said flat surfaces and perpendicular thereto.

10. The printing apparatus of claim 9 wherein said force exerting means includes a wedge shaped element having a pair of side surfaces closely adjacent to said flat surfaces of said frame members and wherein said force exerting surface includes a pair of side edges spaced inwardly from said side surfaces to facilitate movement of said force exerting surface through said opening.

11. The printing apparatus of claim 8 wherein said support and guide means includes gear means for guiding the rolling movement of said curved force exerting surface.

12. The printing apparatus of claim 11 wherein said gear means includes a first gear section connected with said force exerting surface and a second gear section connected with a frame of the printing apparatus, each of said first and second gear sections having gear teeth for corresponding engagement with each other.

13. The printing apparatus of claim 12 wherein the pitch line of the gear teeth of said first gear section coincides with said curved force exerting surface.

14. A printing apparatus comprising:

a pair of frame members, each having a generally flat surface in spaced relationship with and parallel to the flat surface of the other frame member;

a printing station;

a force resisting means for resisting a printing force, said force resisting means being disposed generally perpendicular to and between a portion of said frame members;

a font element having a raised character positionable in printing alignment with said printing station; and a force exerting means positioned in printing alignment with said printing station for exerting a printing force toward said force resisting means including a curved force exerting surface disposed between said frame members and generally perpendicular to the flat surfaces of said frame members and support and guide means for supporting and guiding said force exerting surface in rolling movement with respect to said printing station such that a normal printing force is exerted against successive portions of said raised character during said rolling movement, said support and guide means including gear means for guiding the rolling movement of said curved force exerting surface, said gear means including a first gear section disposed on the opposite side of one of said flat surfaces as said force exerting surface and being connected with said force exerting surface through an opening in said one flat surface and said gear means further including a second gear section connected with the frame member of said one flat surface.

15. The printing apparatus of claim 14 wherein each of said first and second gear sections have gear teeth for corresponding engagement with each other.

16. The printing apparatus of claim 15 wherein the pitch line of the gear teeth of said first gear section coincides with said curved force exerting surface.

17. A removable tape-ribbon cartridge for use in a printing apparatus having a printing station, a force resisting means for resisting a printing force, an interchangeable font element having a raised character positionable in printing alignment with said printing station and a force exerting means for exerting a printing force toward said force resisting means, said cartridge comprising:

a housing containing a supply of printing tape and printing ribbon;

a tape-ribbon and font guide portion connected with and extending outwardly from said housing for guiding said printing tape and said printing ribbon into printing alignment with said printing station;

an opening in said tape-ribbon and font guide portion to define the printing station; and said tape-ribbon and font guide portion including a pair of guide edges for guiding said interchangeable font element into printing alignment and a support edge for supporting said interchangeable font element during a printing cycle.

18. The tape-ribbon cartridge of claim 17 including means for maintaining separation between said printing tape and said printing ribbon during their movement from said housing to said guide portion.

19. The tape-ribbon cartridge of claim 18 including means for preventing relative movement between said printing tape and said printing ribbon during their movement through said guide portion.

20. The tape-ribbon cartridge of claim 19 wherein said means for preventing relative movement between said printing tape and said printing ribbon includes a foam pad disposed near the outer end of said guide portion.

* * * * *